United States Patent [19]

Weber

[11] 4,064,951

[45] Dec. 27, 1977

[54] UNDERREAMER HAVING CUTTER ARM POSITION INDICATION

[75] Inventor: Robert W. Weber, Long Beach, Calif.

[73] Assignee: The Servco Company, a division of Smith International, Inc., Gardena, Calif.

[21] Appl. No.: 668,622

[22] Filed: Mar. 19, 1976

[51] Int. Cl.[2] ..... E21B 47/02

[52] U.S. Cl. ..... 175/45; 175/38; 175/285; 175/317; 175/339

[58] Field of Search ..... 175/38, 39, 40, 45, 175/238, 285, 269, 317, 339, 340, 342

[56] References Cited

U.S. PATENT DOCUMENTS

| | | | |
|---|---|---|---|
| 1,575,120 | 3/1926 | Louderback | 175/342 X |
| 2,046,956 | 7/1936 | Lynch et al. | 175/45 |
| 2,069,482 | 2/1937 | Seay | 175/269 |
| 2,568,256 | 9/1951 | Shaffer | 175/321 X |
| 2,712,435 | 7/1955 | Allen | 175/321 X |
| 2,814,463 | 11/1957 | Kammerer, Jr. | 175/317 X |
| 3,853,184 | 12/1974 | McCullough | 175/39 |
| 3,949,820 | 4/1976 | Furse | 175/286 |

*Primary Examiner*—Ernest R. Purser
*Assistant Examiner*—Richard E. Favreau
*Attorney, Agent, or Firm*—Christie, Parker & Hale

[57] ABSTRACT

An underreaming tool with cutter arm position indication. An elongated body portion has a coupling for coupling one end thereof to a lower end of a lower drill string. A pair of arms are pivotally mounted on the body portion. Means is provided for relatively positioning the cutter arms apart in a cutting position and closer together in a non-cutting position and having an overridable condition wherein either of the cutter arms may be either in a cutting or a non-cutting position. A fluid passage is provided in the body portion comprising an input port at one end of the body portion and first and second output ports. One output port is adjacent to each of the cutter arms. Each of the cutter arms is so positioned in relation to the corresponding output port for at least partially obstructing the corresponding output port when the cutter arm is in one of the cutting and non-cutting positions and for at least partially unobstructing the corresponding output port when the cutter arm is out of the one position, thereby controlling fluid flow therethrough by differing amounts.

7 Claims, 9 Drawing Figures

Fig. 7
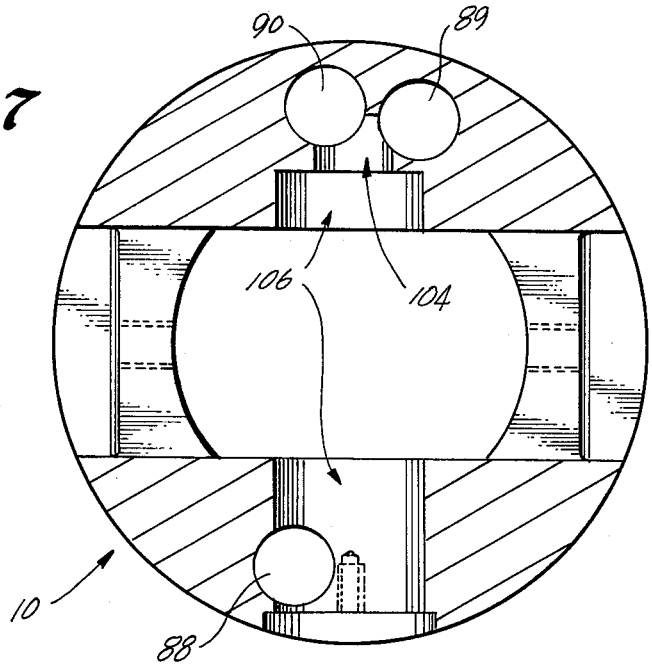
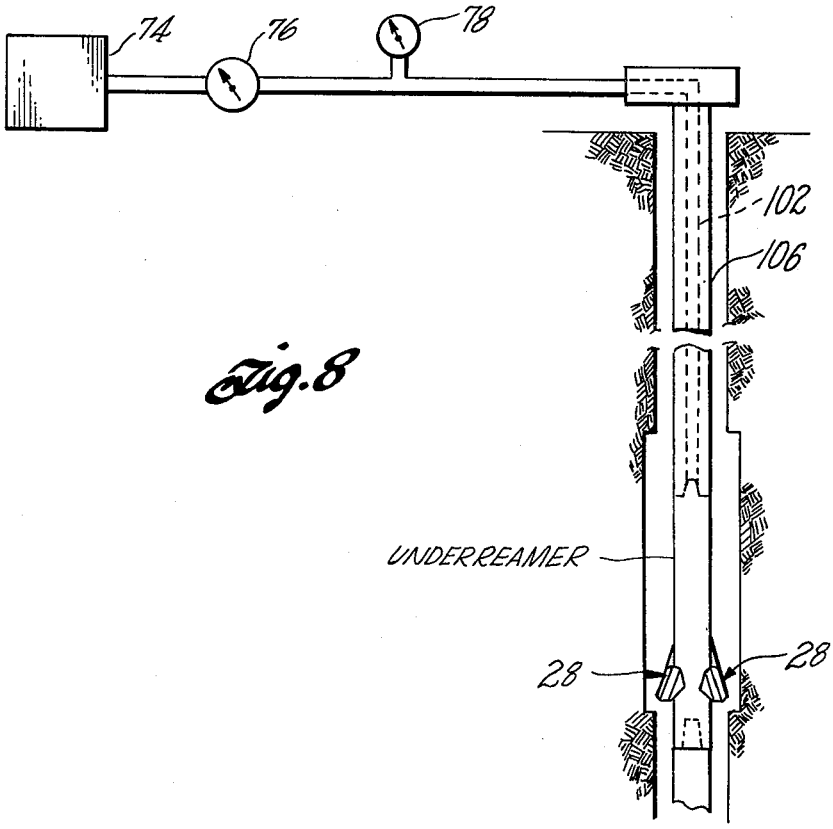
Fig. 8

UNDERREAMER HAVING CUTTER ARM POSITION INDICATION

BACKGROUND

This invention relates to underreaming and chambering tools and more particularly to an arrangement for remotely indicating the position of movable cutter arms on the tool.

Rotary drills are commonly used for earth boring operations. Such drills are employed in oil and gas wells as well as in mining operations. Often it is desirable to enlarge the diameter of a hole drilled at some point a substantial distance below the surface. In oil and gas wells this is commonly referred to as underreaming, whereas in mining it is commonly referred to as chambering. For ease of explanation, both operations are generally referred to herein as underreaming.

To effect underreaming operations a variety of underreamers, hole openers, and the like have been devised. With some devices the underreamer can only be installed on the drill string when underreaming operations are taking place. This requires removal of the drill string each time a change is made from straight drilling to underreaming or vice versa.

Other devices employ various controllable cutter actuators to move underreaming cutters into or out of underreaming position while a drill is connected below the underreamer for drilling purposes. Some such devices use fluid pressure, for example, due to recirculating drilling mud or the like to actuate a cutter into an extended cutting or underreaming position. In other known underreaming devices, mechanical adjustment of the drill string connected to the underreamer and fluid or pneumatic pressure applied through the drill string is used to move cutters to the underreaming position. One such device is disclosed in U.S. Pat. No. 3,817,339.

Another underreamer which has a purely mechanical control is disclosed in copending patent application Ser. No. 668,412, filed Mar. 19, 1976 entitled "Underreamer Having Splined Torgue Transmitting Connector Between Telescoping Portions for Control of Cutter Position", now abandoned, A continuation of which was assigned Ser. No. 736,109 and was filed Oct. 27, 1976.

After an underreaming operation has been performed by an underreaming tool and the underreaming tool is removed from the hole, it is of extreme importance that the cutter arms be fully retracted to a non-cutting position in order to allow the underreaming tool to be removed from the hole without cutting away the smaller diameter hole above the underreamed portion. This is of extreme criticality in mining operations where the enlarged underreamed portion of the hole is to be used for blasting purposes. In this connection the enlarged diameter hole must be of limited length down hole in order to concentrate the explosive force down hole.

In one underreamer disclosed in copending patent application Ser. No. 668,557, filed Mar. 19, 1976, entitled UNDERREAMING TOOL WITH OVERRIDING EXTENDED ARM RETAINER, the cutter arms have an overridable means for holding them in an extended underreaming position. This allows the cutter arms to clean off any debris buildup as the underreamer is lifted up hole. When the smaller diameter hole above the underreamed area is reached, the smaller diameter hole engages the extended cutter arms, causing the overridable means to allow the arms to retract to a clearance position.

It has been found in underreaming tools using an overridable means for holding the cutter arms in the extended underreaming position that the cutter arms may remain extended due to restraining forces on the cutter arms created by debris buildup under the arms during the underreaming and drilling operations. As a result when the underreamer is removed from the hole the extended cutter arms will cut out the hole above the underreamed area. Thus it is desirable for the operator to known when the cutter arms do not properly retrack to a clearance position. However, it is difficult for the operator to determine the cutter arm position when the underreamer is remotely located down hole.

BRIEF SUMMARY OF THE INVENTION

Briefly, an underreaming tool, in accordance with the present invention, has combined cutter arm position indicating and cutter cleaning features. Included is at least one elongated body portion. At least one cutter arm is pivotally mounted on the body portion. Means is provided for pivotally positioning the cutter arm in a cutting position or a different non-cutting position. At least one fluid passage is provided in the body portion having an input port for receipt of fluid and an output port. The output port is displaced from the cutter arm pivot in the body portion. The cutter arm has a portion which is adjacent the body portion and substantially blocks the output port when the cutter arm is in the non-cutting position. The passage adjacent and including the output port is arranged to direct fluid, passing through the passage, in the direction of a cutter mounted on the cutter arm when in the cutting position.

DRAWINGS

These and other features and advantages of the present invention will be appreciated as the same become better understood by reference to the following detailed description of the presently preferred embodiment when considered in connection with the accompanying drawings wherein.

Figure 3:
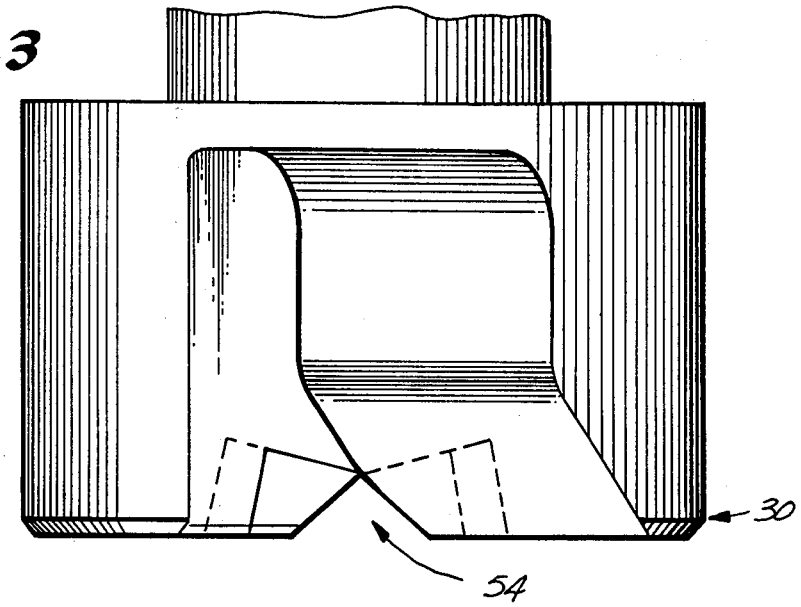
FIG. 3 is a side elevation view of the cam shown in FIGS. 1 and 2.
Figure 4:
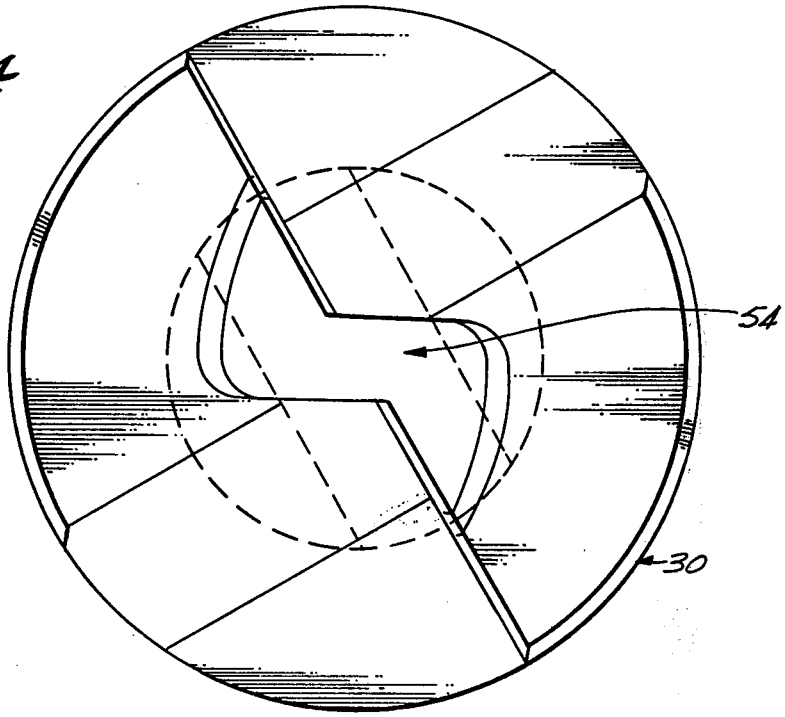
FIG. 4 is a bottom view of the cam shown in FIG. 3.
Figure 5:
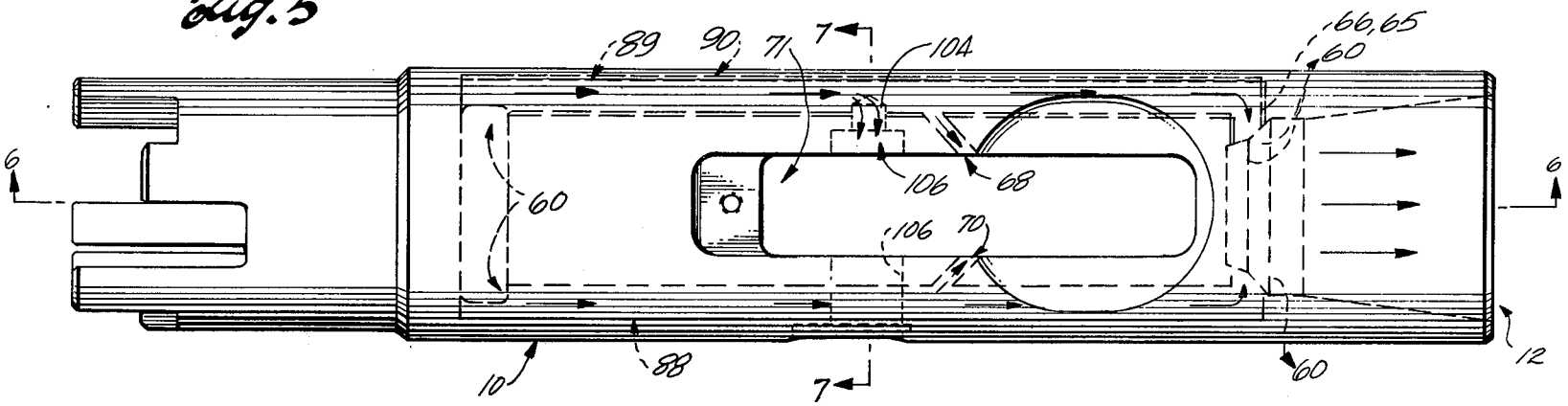
FIG. 5 is a side elevation view of the lower body portion 10 of the underreamer taken from the left side in FIG. 1.

FIG. 7 is a transverse cross-sectional view of the lower body portion 10 taken along the lines 7—7 of FIG. 5; and FIG. 8 is a schematic representation of a drilling system embodying the underreamer of FIGS. 1 through 8 with cutter arm position indication.

DESCRIPTION

Figure 1:
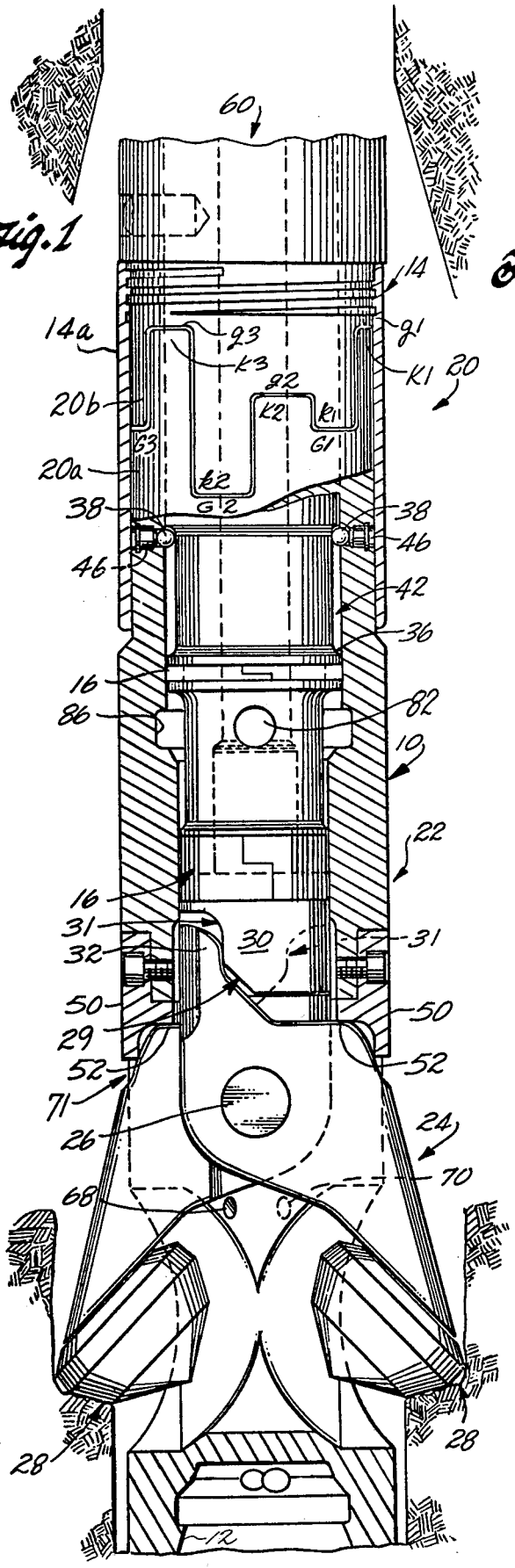
FIG. 1 is a longitudinal cross-section of the lower underreamer portion with the cutter arms extended and embodies the present invention.
Figure 2:
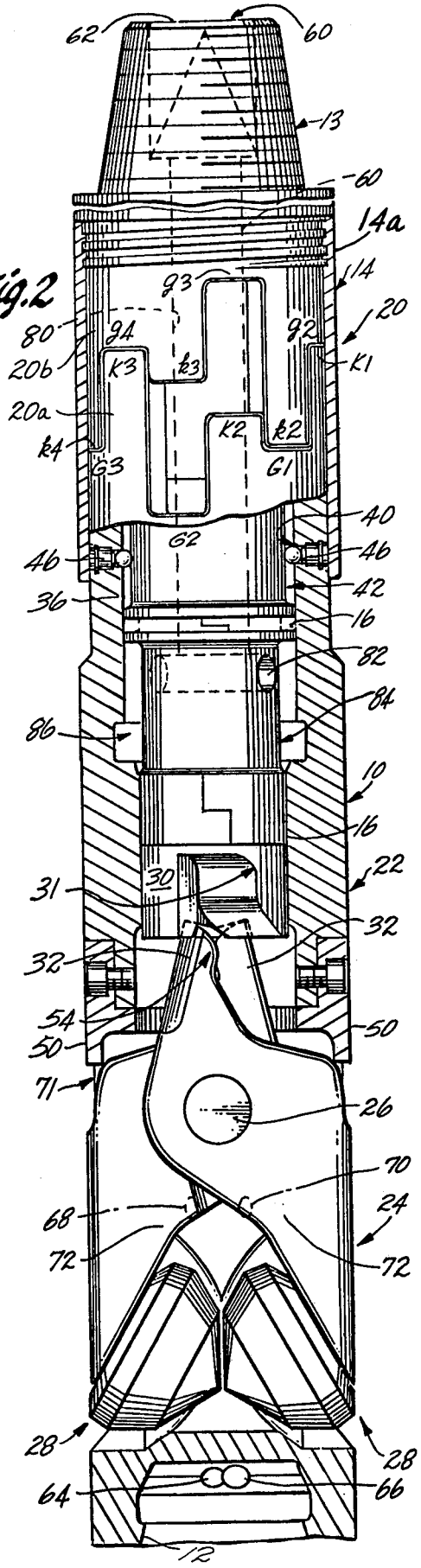
FIG. 2 is a longitudinal cross-section similar to FIG. 1 with the cutter arms retracted.

FIGS. 1 and 2 illustrate in side view and partially in section a combined underreamer and latching selector sub constructed according to the principles of the present invention. As illustrated in the present and preferred embodiment, the underreamer has a lower generally tubular shaped outer body portion 10 which may be connected to a lower portion of a drilling string by a conventional threaded female joint 12. The lower portion of the drill string (not shown) typically includes a conventional drill for forming a hole or bore in the earth as the drill string is rotated. Such drills are conventional, forming no part of the present invention, and are not further described herein. The drill is usually coupled directly to the underreamer. Also provided is an upper generally tubular shaped inner body portion 14. The upper body portion contains a threaded male joint 13 for connecting to the lower portion of an upper drill string (not shown). The upper and lower body portions 10 and 14 form longitudinally telescoping upper and lower body portions as they move relative to each other in a longitudinal direction.

The lower portion of the upper body portion 14 slides along the interior wall of the tubular shaped lower body portion 10. Low friction ring and seal bearings 16 are spaced apart longitudinally in grooves formed around the circumference of the lower portion of the upper body portion 14. Although the invention is not limited thereto, NYLATRON (a registered trademark) GS type bearings made by the Polymer Corporation are used. Significantly the ring and seal bearings 16 form virtually frictionless bearing surfaces on the interior wall of the lower portion 10. This is quite important as it allows the upper telescoping portion 14 to be easily rotated relative to the lower portion 10 while the portion 10 is only held by friction in a hole being bored.

A splined connector 20 with two separable circular portions is provided in between the telescoping upper and lower body portions 14 and 10 at the tubular shaped portions thereof. Significantly, the splined connector 20 has a first and a second engaged position. Each position has a different angular and a different longitudinal engaged position for the splined connector and hence the upper and lower telescoping portions 14 and 10.

The splined connector 20 has identical lower and upper portions **20*a* and 20*b*, respectively. The lower splined connector portion 20*a* includes longitudinally facing and staggered grooves Gl,G2 . . . G6 and longitudinally facing and staggered keys K1,K2 . . . K6 in the lower body portion 10**. Mating with the notches and grooves in the lower body portion are longitudinally facing and staggered grooves *g*1,*g*2,*g*3 . . . *g*6, and longitudinally facing and staggered keys *k*1,*k*2, . . . *k*6 in the upper body portion **20*b*. The keys and grooves are arranged into three 120° sections. The keys and grooves in one section are identical with those in each of the other sections. Each key and groove is 30° in width, although the invention is not limited thereto. Note with respect to FIG. 1** that keys *k*1,*k*2 . . . *k*6 extend into and engage the grooves G1,G2 . . . G6 whereas the keys K1,K2 . . . K6 extend into and engage the grooves *g*1,*g*2 . . . *g*6. Not all keys and grooves can be seen in FIGS. 1 and 2. By longitudinally lifting the upper portion 14 (upward as depicted in FIG. 2) with respect to the lower portion 10 and rotating it clockwise 60° as viewed from the top and then allowing the upper portion 14 to move downwardly in the direction of the lower portion 10, different notches and keys become engaged. For example, in FIG. 2 the keys K1,K3 now extend into grooves *g*2,*g*4. Similarly, keys *k*2,*k*4 now extend into and engage the grooves G1,G3. With such an arrangement the upper portion 14 is held in a different angular and longitudinal position with respect to the lower body portion 10 in FIG. 1 as compared with FIG. 2.

Thus the keys and grooves K1,G1,K2,G2 form one 120° angular section of the splined connector on the lower portion 10. Similarly, grooves and keys *g*1,*k*1,*g*2,*k*2 form one 120° angular section of the portion of the splined connector on the upper portion 14. Two additional 120° angular sections of the splined connector are provided on the upper and lower telescoping portions 14 and 10 extending around the underreamer.

Figure 2A:
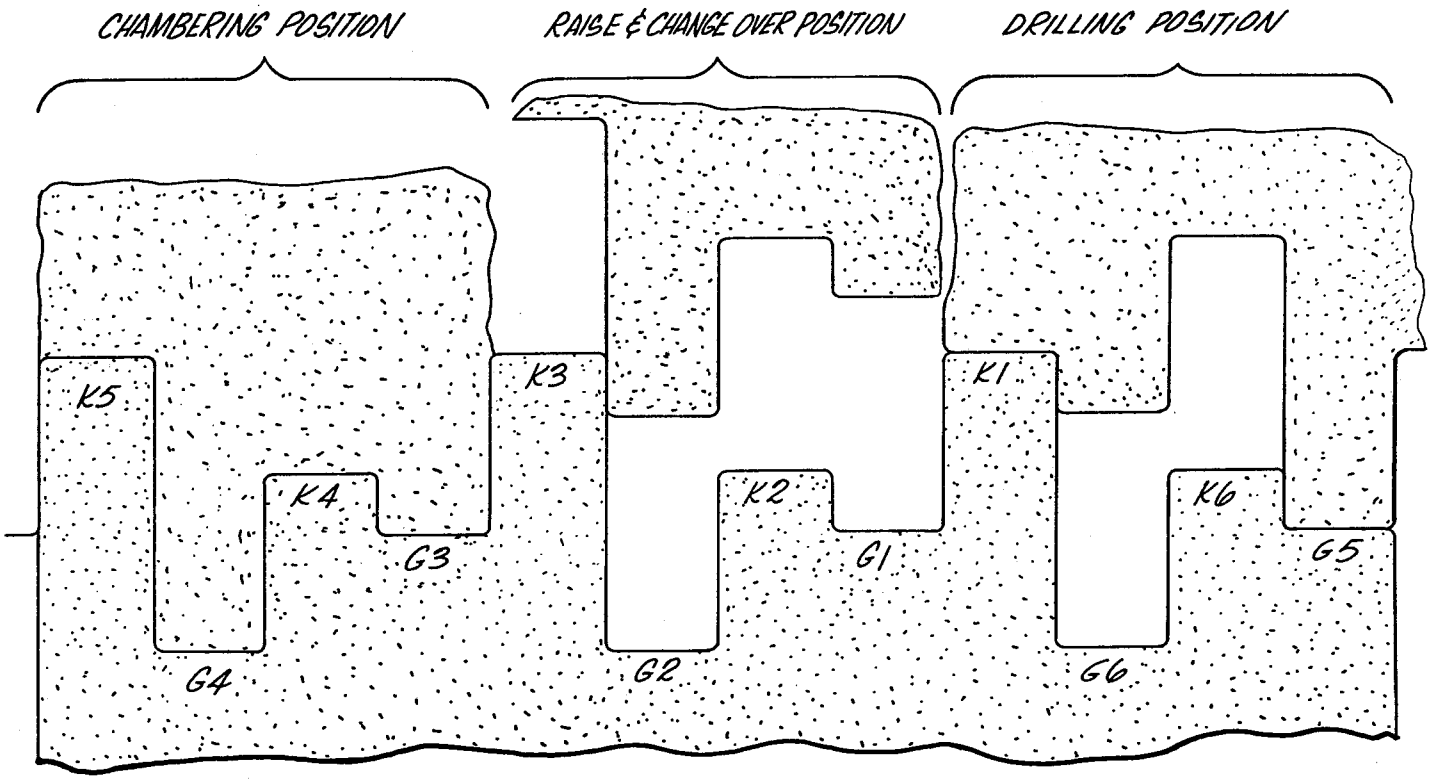
FIG. 2A is a flat pattern view depicting the three positions of the connector portions making up the splined connector.

FIG. 2A shows a flat pattern view of the circumference of the lower connector portion **20*a* with its keys and grooves. An example of one segment of the upper portion 20*b* of the connector 20 is shown above the lower connector portion 20*a* depicting the three positions of the splined connector 20**. From left to right the connector portions are in the chambering position, the changeover position and the drilling position.

A pair of cutter arms 24 are pivotally mounted on the lower body portion 10 by means of a pivot 26. The arms are pivotally mounted in a slot 71 which extends through the lower portion 10 from side to side transverse to the longitudinal axis of the underreamer. Only one half of the slot is seen in FIGS. 1 and 2, the other half being essentially a mirror image of the half shown.

Rock crushing cutters 28 of the conventional sort, and illustrated schematically, are rotatably mounted on the lower ends of the two cutter arms 24. On the lower end 22 of the upper portion 14 is a cam 30. A cam follower 32 is provided on each of the arms at the opposite end of the arms from the cutters 28. The cam follower 32 end of the arms 24 is about ½ the width of the center portion of the arms and the two arms are mounted on the pivot in a scissor fashion.

Also provided is a stop for limiting the extent of longitudinal movement between the upper and lower portions 14 and 10. The stop includes an elongated outwardly facing ring shaped groove 42 on the outer wall of the upper portion 14. The groove 42 has a stop portion 36 at the lower end of the groove 42 which, to be explained in more detail, engages balls to stop movement between the telescoping portions before the splined connector is moved longitudinally apart to a non-engageable position.

Also included in the stop is an inwardly facing ring shaped groove 40 adjacent to the outwardly facing groove 42 and positioned in the inner wall of the lower portion 10. Also included are a plurality of balls 38 which are retained in both of the grooves 40 and 42. In operation, the balls 38 engage the stop portion 36 of the groove 42 to stop the longitudinal movement between the upper and lower portions 14 and 10 at the extremity of their movement apart.

Three plugs 46 (only two being shown) are positioned into each of a plurality of openings drilled along different radii around the periphery of the lower portion 10 and adjacent to the groove 40. The openings are large enough for the balls 38 to be inserted therethrough and in between the grooves 40 and 42. The balls are positioned through these openings into the grooves and then each plug 46 is positioned in place, and locked by a "C" shaped retaining ring, to keep the balls 38 from sliding out of the grooves.

A tubular shaped sleeve **14*a* is threaded onto the upper portion 14. The sleeve 14*a* extends over the splined connector even when the upper portion 14 has been raised to its full extended position with the balls 38 in engagement with the stop portion 36. The sleeve 14***a* also extends over the plugs 46 when the splined connector 20 is in the underreaming position or the drilling position depicted in FIGS. 1 and 2, respectively. As a result, the plugs as well as the splined connector are protected from dirt and other debris encountered in drilling operations. However, the sleeve 14*a* will expose the plugs 46 when the upper and lower telescoping portions and hence the splined connector portions 20 are raised to the changeover position, thereby allowing access to the plugs 46 for assembly, disassembly or repair.

Two stop lugs 50 are bolted onto the lower portion 10 adjacent to the arms 24. Stop lugs 50 are inactive when the cutter arms are in their retracted position depicted in FIG. 2. When the cutter arms are extended as depicted in FIG. 1, a shoulder 52 on each of the arms 24 engages the respective stop lug and limits the outward movement of the cutter arms to a preselected extended position. Engagement of the shoulders with the stop lugs determines the size of the underreaming portion of the hole.

The cam 30 has a slot 54 into which the cam follower 32 ends of the arms 24 extend. The slot 54 is best seen in FIGS. 2, 3 and 4 and is dimensioned so as to engage the cam followers 32 and hold the arms in their clearance position depicted in FIG. 2 when the splined connector is in the position depicted in FIG. 2.

By providing the slot 54 at the end of the cam for engaging the cam followers, the cutter arms are held in their clearance position even when subjected to centrifugal force thereby preventing their inadvertent movement outwardly which may occur when the drill string is being rotated at a high speed.

Consider briefly the operation of the underreamer. An upper drill string is connected at the male threaded joint or connector 13 and a lower drill string is connected at the female threaded joint or connector 12. Assume that the underreamer is positioned in the condition depicted in FIG. 2. In this position the slot 54 in the cam 30 of the upper portion 14 holds the cutter arms 24 in the retracted clearance position. This is true even if the tool is rotated at high speed, subjecting the cutter arms to outward forces.

Should it be desired to extend the cutter arms 24 to simultaneously underream and drill, the upper drill string is raised from the drilling position of the splined connector 20 shown in FIG. 2 to the changeover position where the two portions of the splined connector 20 disengage, and then the upper drill string and hence the upper body portion 14 are rotated clockwise as viewed from the top until the side walls of keys *k*2 and *k*3 strike. This will rotate the cam 30 to the position indicated in FIG. 1. The drill string and hence the upper portion 14 are then lowered to the chambering position of the splined connector 20 while the lower portion 10 is held in the hole until the cam surfaces 29 on the cam 30 act against the cam followers 32 and move the cutter arms 24 to the extended position shown in FIG. 1. The weight of the drill string will cause this action. The upper portion of the camming surfaces 20 form a lock 31 to lock the cutter arms in the extended position depicted in FIG. 1.

When the cutter arms are in either the clearance position of FIG. 2 or the extended position of FIG. 1, the splined connector 20 provides a series of substantially longitudinally extending side walls which provide torque transmission between the upper and lower portions 14 and 10 during drilling and/or underreaming operations. During underreaming operations when the connector 20 is in the chambering position, as depicted in FIG. 1, the adjacent side walls of the two connector portions 20*a* and 20*b* abut fully along their entire length, giving maximum torque transmission.

When it is desired to retract the cutter arms 24 from the extended to the clearance position, the upper drill string is again lifted upward, moving the upper portion 14 upward with respect to the lower portion 10 until the grooves and keys, which are engaged in FIG. 1, are disengaged. The cutter arms 24 will rotate back to the clearance position of FIG. 2, normally under their own weight. The upper drill string is then rotated counterclockwise as viewed from the top and then the drill string and upper portion 14 are allowed to move downward under their own weight until the splined connector 20 is engaged as depicted in FIG. 2, thereby holding the outer portion 14 in an upward position with respect to the position depicted in FIG. 1. In the process the slot 54 passes over the ends of the cam followers 32 and automatically locks the arms in the retracted clearance position of FIG. 2.

The splined connector is disclosed and claimed in co-pending U.S. Pat. application Ser. No. 736,109.

Significant to the present invention a fluid passage 60 extends through the upper and lower telescoping portions 14 and 10. Included in the passage 60 is an input port 62 in the upper connector 13 and ports 64, 65 and 66 in the lower connector 12. It will be appreciated that the passage 60 extending between the ports 62 and 64, 65 and 66 allows fluid such as air, water, drilling fluid, etc., to pass from the drill string through the drill string down to the connector 13 through the underreamer and out of the ports 64, 65 and 66 through the connector 12 into the lower drill string as is common in the drilling art.

The passage 60 has output ports 68 and 70 provided in the lower telescoping portion 10. The ports 68 and 70 open into a slot 71 in the lower telescoping portion, the port 68 opening adjacent to the arm on the left and the port 70 opening adjacent to the arm on the right in FIG. 1. Port 70 is depicted in broken line to indicate it lies perpendicular to the plane of FIG. 1 above the right arm. To be explained in more detail, the arms 24 each have a portion 72 which forms means for partially obstructing the respective output ports when the cutter arm is in the non-cutting position depicted in FIG. 2, whereas the cutter arm exposes the respective output port when the arm is in the cutting position depicted in FIG. 1. As a result, the arms 24 directly control the fluid flow through the ports 68 and 70 by differing amounts, depending on the obstruction to the fluid flow through the ports 68 and 70.

The obstruction of ports 68 and 70 is used to form an indication at the top of the bore of the position of the cutter arms. Referring to FIG. 8, the upper drill string 106 contains a passage 102 for fluid flow, as is conventional in the drilling art, and has its upper end connected to a source of fluid pressure 74. For purposes of explanation, the source of fluid is a source of air such as is used in mine drilling operations. The source of fluid pressure 74 provides fluid down through the drilling string and into the underreamer for several purposes, including cooling and cleaning of a drill attached below the underreamer and for cleaning and cooling of the cutter bearings on the underreamer cutter arms as described in more detail.

According to one embodiment of the present invention, a flow meter 76 and a pressure meter 78 are connected into a pipe between the fluid source 74 and the drill string to determine whether or not one or both of the cutter arms 24 has been held in a cutting position when the arm should have been rotated to the non-cutting position depicted in FIG. 2. In this regard, assume that both arms are in an extended cutting position as depicted in FIG. 1, completely exposing the output ports 68 and 70. Under these conditions the pressure indicated by the meter 78 and the flow indicated by the meter 76 will indicate, respectively, a relatively low pressure and high fluid flow. Assume that both cutter arms are as depicted in FIG. 2, completely covering over and obstructing the ports 68 and 70. Under these conditions the pressure indicated by the meter 78 will be at a relatively higher level, and the flow indicated by meter 76 will be at a relatively lower level than for the condition depicted in FIG. 1.

Assume now that only one of the arms is as depicted in FIG. 2 and the other arm is as depicted in FIG. 1. Under these conditions the pressure and flow meters 78 and 76 will indicate a relatively intermediate pressure and flow rate condition. As a result it is possible for the operator to determine whether one or both of the arms has been held in an extended cutting position by rock or other material dislodged during an underreaming operation. The detection of an arm held in a cutting position is quite important. In this regard it will be noted that the splined connector together with the cam 30 form a means for relatively positioning the cutter arms in either a cutting position, as depicted in FIG. 1, or a non-cutting position, as depicted in FIG. 2. However, when the upper drill string connected to the connector 13 is lifted upwardly, for example, after underreaming, for the purpose of withdrawing the underreamer from the hole, the arms 24 normally act under their own weight due to the pull of gravity, and both retract to the non-cutting position indicated in FIG. 2. Thus the splined connector in combination with the weight of the cutter arms forms an arm positioning means which is overridable in the sense that should rock or other debris from the underreaming or drilling operation become lodged in between the cutters and the slot 71 in the lower portion of the lower telescoping portion 10, the arms will not retract as depicted in FIG. 2, and one or both of the arms may remain extended as depicted in FIG. 1. As a result, as the underreamer is lifted from the hole, the extended cutter arms will start erroneously cutting away the portion of the hole above the underreamed area, thereby enlarging the underreamed area possibly to an unacceptable amount. With the arrangement depicted in FIG. 8, the operator can immediately and easily detect when one or both of the arms is erroneously in a cutting position.

Considering the details of passage 60 in more detail, it will be seen that the passage 60 has a passage portion 80 which extends through the center of the tubular shaped upper telescoping portion 14, to a port 82 provided normal to the axis of the upper telescoping portion 14. A ring shaped cavity 84 extends around the upper telescoping portion 14 and encompasses the port 82.

A further ring shaped cavity 86 is positioned around the inner wall of the lower telescoping portion 10 adjacent to and opposite to the cavity 84. The seals 16 on either side of the cavity 84 prevent fluid from leaking out from the cavities 84 and 86.

Figure 6:
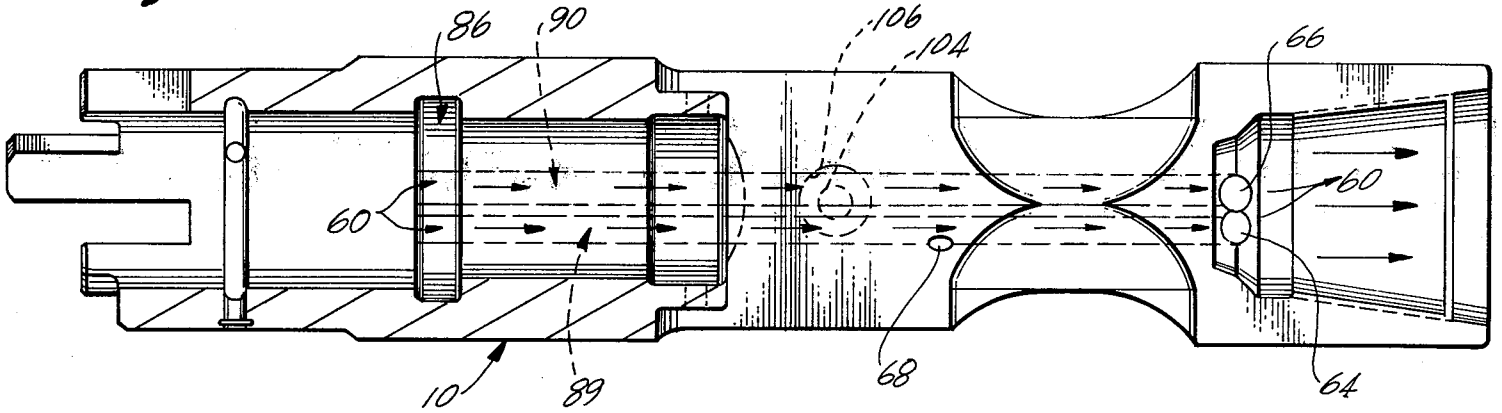
FIG. 6 is a cross-sectional view of the lower body portion 10 taken along the lines 6—6 of FIG. 5.

Referring specifically to FIGS. 5 and 6, the passage 60 includes passage portions 88, 89 and 90 which extend through the wall of the lower telescoping portion 10 from the cavity 86 to the ports 64, 65 and 66, respectively. Note that the passages 89 and 90 extend parallel to each other along generally the same side portion of the lower telescoping portion 10, both opening into the connector 12, whereas the passage portion 88 is generally along the opposite side.

Significant to the invention and as depicted in FIG. 5 the passages adjacent to and including output ports 68 and 70 extend inwardly at an angle to the axis of the upper and lower telescoping portion 14 and 10. As a result, when the cutting arms are in a cutting position as depicted in FIG. 1, the fluid flow from ports 68 and 70 acts to clean the drilling debris from the tool that would otherwise tend to collect on the cutters and thereby help to prevent the undesirable buildup of debris which would hold the arms in the cutting position when the upper drill string is lifted.

In addition, a passage (not shown) is provided from the passage 60 to the cutters 28 generally in the manner shown and described in U.S. Pat. application Ser. No. 551,600 filed Feb. 21, 1975 in the name of John A. Furse, and assigned to the same assignee as this application. A passage extends from an opening 104 into circular mountings for the pivot 26 and through the arms. As described in the above referenced patent application the passage through the arms communicates with orifices which open to bearings (not shown) for the cutters 28. The air flow through the arms to the bearings in the cutters provides cooling and cleaning action as more completely described in the above referenced patent application. The details of the cooling and cleaning system for the cutter bearings is not disclosed as it is not essential to an understanding of the present invention.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed:

1. An underreaming tool with combined cutter arm position indicating and cutter cleaning means comprising:

at least one elongated body portion;

at least one cutter arm pivotally mounted on said body portion and a cutter on said arm;

means for pivotally positioning said at least one cutter arm in a cutting position or a different non-cutting position; and at least one fluid passage in said body portion comprising an input port for receipt of fluid and an output port, said output port being displaced from the cutter arm pivot in said body portion;

said cutter arm having a portion which is adjacent said body portion and substantially blocks said output port when said cutter arm is in said non-cutting position, said passage adjacent and including said output port being arranged to direct fluid, passing therethrough, in the direction of said cutter when said cutter arm is in said cutting position.

2. An underreaming tool according to claim 1 comprising:

an additional cutter arm pivoted on said body portion having an additional cutter thereon and wherein said passage comprises an additional output port;

said additional output port being positioned in said body portion and said additional cutter arm having a portion, between the pivot thereof and said additional cutter, which is adjacent said body portion and substantially blocks said additional output port when said additional cutter arm is in a non-cutting position;

said passage adjacent said further output port and said further output port being arranged to direct fluid, passing therethrough, in the direction of said further cutter when said cutter arm is in a cutting position.

3. An underreamer according to claim 2 wherein said cutter arm and further cutter arm are pivotally mounted in scissor relation and wherein said body portion has a first portion containing said output port and a second body portion containing said further output port on the outer sides of said cutter arms in such scissor relation.

4. An underreamer according to claim 3 wherein said first and second body portions are separated by a notch extending therebetween, each said cutter arm and each said cutter being positioned in said notch when the corresponding cutter arm is in said non-cutting position.

5. An underreaming tool with combined cutter arm position indicating and cutter cleaning means comprising:

at least one elongated body portion;

at least one cutter arm pivotally mounted on said body portion and a cutter on said arm;

means for pivotally positioning said at least one cutter arm in a cutting position or a different non-cutting position, the positioning means being overridable, due to a restraining force on said at least one cutter arm, when positioning said at least one cutter arm in at least one of said positions thereof; and at least one fluid passage in said body portion comprising an input port for receipt of fluid and an output port, said output port being displaced from the cutter arm pivot in said body portion;

said cutter arm having a portion which is adjacent said body portion and substantially blocks said output port when said cutter arm is in said non-cutting position, said passage adjacent and including said output port being arranged to direct fluid, passing therethrough, in the direction of said cutter when said cutter arm is in said cutting position.

6. An underreaming tool with combined cutter arm position indicating and cutter cleaning means comprising:

at least one elongated body portion;

at least one elongated cutter arm and a cutter adjacent an end on said cutter arm;

means for pivotally mounting said cutter arm adjacent an end thereof opposite from said cutter;

means for pivotally positioning said at least one cutter arm in a cutting position or a different non-cutting position, the positioning means being overridable, due to a restraining force on said at least one cutter arm, when positioning said at least one cutter arm in at least one of said positions thereof; and at least one fluid passage in said body portion comprising an input port for receipt of fluid and an output port, said output port being displaced from the cutter arm pivot in said body portion;

said cutter arm having a portion, displaced from the pivot thereof, which is adjacent said body portion and substantially blocks said output port when said cutter arm is in said non-cutting position, said passage adjacent and including said output port being arranged to direct fluid, passing therethrough, in the direction of said cutter when said cutter arm is in said cutting position.

7. An underreaming tool with combined cutter arm position indicating and cutter cleaning means comprising:

at least one elongated body portion having at least one opening in the side thereof;

a pair of elongated cutter arms pivotally mounted on said body portion and in said at least one opening, each said cutter arm having a cutter thereon;

means for pivotally positioning said pair of cutter arms in a cutting position or a different non-cutting position, the positioning means being overridable, due to a restraining force on at least one of said pair of cutter arms, when positioning such cutter arm in at least one of said positions thereof; and at least one fluid passage in said body portion comprising an input port for receipt of fluid and a pair of output ports in said body portion positioned within and on opposite sides of said opening, a different one of such output ports corresponding to each of said cutter arms, each of said output ports being displaced from the pivot of the corresponding cutter arm;

each of said cutter arms having a portion which is adjacent said body portion and substantially blocks the corresponding output port when in said non-cutting position, said passage adjacent to and including each said output port being arranged to direct fluid, passing therethrough, in the direction of the cutter on the cutter arm corresponding to such output port when such cutter arm is in said cutting position.

* * * * *

UNITED STATES PATENT AND TRADEMARK OFFICE

CERTIFICATE OF CORRECTION

PATENT NO. : 4,064,951

DATED : Dec. 27, 1977

INVENTOR(S) : Robert W. Weber

It is certified that error appears in the above-identified patent and that said Letters Patent are hereby corrected as shown below:

Column 1, line 60, "557" should be -- 577 --;
Column 3, line 30, "lower portion" should be -- lower body portion --;
Column 5, line 62, "20" should be -- 29 --.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*